US008449065B2

(12) United States Patent
Nakayama

(10) Patent No.: US 8,449,065 B2
(45) Date of Patent: May 28, 2013

(54) IMAGE FORMING APPARATUS

(75) Inventor: Junpei Nakayama, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 261 days.

(21) Appl. No.: 13/028,123

(22) Filed: Feb. 15, 2011

(65) Prior Publication Data

US 2011/0199412 A1 Aug. 18, 2011

(30) Foreign Application Priority Data

Feb. 16, 2010 (JP) ..... 2010-031214

(51) Int. Cl.
*B41J 29/38* (2006.01)

(52) U.S. Cl.
USPC ..... 347/14

(58) Field of Classification Search
None
See application file for complete search history.

(56) References Cited

FOREIGN PATENT DOCUMENTS

| | | |
|---|---|---|
| JP | 2003-292196 | 10/2003 |
| JP | 2007-260991 | 10/2007 |

*Primary Examiner* — Stephen Meier
*Assistant Examiner* — Tracey McMillion
(74) *Attorney, Agent, or Firm* — Kilpatrick Townsend & Stockton LLP

(57) ABSTRACT

A detection unit that detects the width of a medium on a placement surface is mounted on a carriage, a reflection plate is formed on one end of the placement surface while the reflection plate is inclined at the placement surface, and the carriage is moved to a position in which the carriage faces the reflection plate, so that the thickness of the medium is determined based on the output of the detection unit while moving the carriage. Therefore, the thickness of the medium is detected with high accuracy without using a dedicated sensor.

6 Claims, 7 Drawing Sheets

IMAGE FORMING APPARATUS

CROSS REFERENCES TO RELATED APPLICATIONS

The entire disclosure of Japanese Patent Application No. 2010-31214, filed Feb. 16, 2010 is expressly incorporated by reference herein.

BACKGROUND

1. Technical Field

The present invention relates to an image forming apparatus which forms an image by discharging a liquid on a medium.

2. Related Art

In the related art, as this type of image forming apparatus, an apparatus which detects the thickness of paper in such a way that an optical readout apparatus, such as a Charge-Coupled Device (CCD) camera or an artificial retina chip, is installed on one side of a paper feeding mechanism and one side face of the paper is optically read out by the optical readout apparatus (for example, refer to JP-A-2003-292196), and an apparatus which includes a gap sensor for converting the movement of a paper roller in the vertical direction into an electrical signal, and detects the thickness of the paper in response to a signal detected by the gap sensor when the paper is fastened by the paper roller (for example, refer to JP-A-2007-260991) have been proposed.

However, since each of the above-described apparatuses requires that a dedicated sensor be installed in order to detect the thickness of the paper, there is a problem in that a new area is necessary for the installation, such that the apparatus increases in size and is disadvantageous in terms of cost.

SUMMARY

An advantage of some aspects of the invention is to provide an image forming apparatus that detects the thickness of a medium without using a dedicated sensor.

An image forming apparatus of an aspect of the invention includes the following units in order to implement the above-described advantage.

An image forming apparatus according to an aspect of the invention is an image forming apparatus that forms an image by discharging a liquid on a medium, the image forming apparatus including: a discharge head that discharges a liquid; a movement unit that reciprocates the discharge head such that the discharge head moves across the medium placed on a placement surface; a light emitting/receiving unit that is mounted on the movement unit so as to be capable of moving, and that includes a light emitting section for emitting light in a substantially vertical direction to the placement surface and a light receiving section for receiving reflected light from the substantially vertical direction to the corresponding placement surface; a reflection member that is formed on a non-placement surface which is different from the placement surface, and that, when the light emitting/receiving unit is moved into a position which faces the non-placement surface by the movement unit, reflects light emitted from the light emitting element in a substantially parallel direction to the placement surface, and that reflects the light from the substantially parallel direction to the placement surface in a substantially vertical direction to the corresponding placement surface; a position detection unit that detects a position in a movement direction of the light emitting/receiving unit; and a medium size determination unit that, when the medium is placed on the placement surface, determines a width of the medium based on a light reception signal detected by the light emitting/receiving unit and a position signal detected by the position detection unit while moving the light emitting/receiving unit such that the light emitting/receiving unit moves across the medium; and determines a thickness of the medium based on the light reception signal detected by the light emitting/receiving unit and the position signal detected by the position detection unit while moving the light emitting/receiving unit such that the light emitting/receiving unit moves across the reflection member.

The image forming apparatus according to the aspect of the invention may be configured to include the light emitting/receiving unit that can be moved by the movement unit that reciprocates the discharge head, and includes the light emitting section that emits light in the substantially vertical direction to the placement surface of the medium and the light receiving section that receives reflected light from the substantially vertical direction to the placement surface; provided with the reflection member that reflects light emitted from the light emitting element in the substantially parallel direction to the placement surface, and that reflects light from the substantially parallel direction to the placement surface in the substantially vertical direction to the placement surface when the light emitting/receiving unit is moved to the position which faces a non-placement surface which is different from the placement surface by the movement unit; configured to determine the width of the medium based on the light reception signal detected by the light emitting/receiving unit and the position signal detected by the position detection unit while moving the light emitting/receiving unit such that the light emitting/receiving unit moves across the medium when the medium is placed on the placement surface; and configured to determine the thickness of the medium based on the light reception signal detected by the light emitting/receiving unit and the position signal detected by the position detection unit while moving the light emitting/receiving unit such that the light emitting/receiving unit moves across the reflection member. Therefore, the width and thickness of the medium can be detected using a common detection unit, so that it is not necessary to provide a dedicated sensor that detects the thickness of a medium.

In the image forming apparatus according to the aspect of the invention, the medium size determination unit may generate a light reception signal waveform in response to the light reception signal corresponding to each position of the light emitting/receiving unit, and may determine the thickness of the medium based on the generated light reception signal waveform. Therefore, the thickness of the medium can be determined with high accuracy using a simple process. In the image forming apparatus according to the aspect of the invention, the medium size determination unit may determine the thickness of the medium based on a width in which the position of the light emitting/receiving unit corresponding to the light reception signal from the light emitting/receiving unit, which exceeds a predetermined level in the generated light reception signal waveform, is continuous, and the medium size determination unit may determine the thickness of the medium in such a way that a medium type is specified by comparing the generated light reception signal waveform with signal waveforms of a plurality of types of medium each of which has a different thickness. Therefore, the thickness of the medium can be determined with high accuracy using a simple process.

Further, the image forming apparatus according to the aspect of the invention may further include: a head interval adjustment unit that adjusts an interval between heads, which is an interval between the discharge head and the placement surface; and a control unit that controls the head interval adjustment unit such that the interval between heads is adjusted based on the thickness of the medium determined by the medium size determination unit when an image is formed on the medium, and that controls the movement unit and the discharge head such that the image is formed on the medium after the interval between the heads is adjusted. Therefore, an image can be formed on the medium with high accuracy.

Further, in the image forming apparatus according to the aspect of the invention, the reflection member may be a member on which a mirror processing is performed. Therefore, the light reception precision of the light emitting/receiving unit is excellent, thereby controlling erroneous detection.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1A:
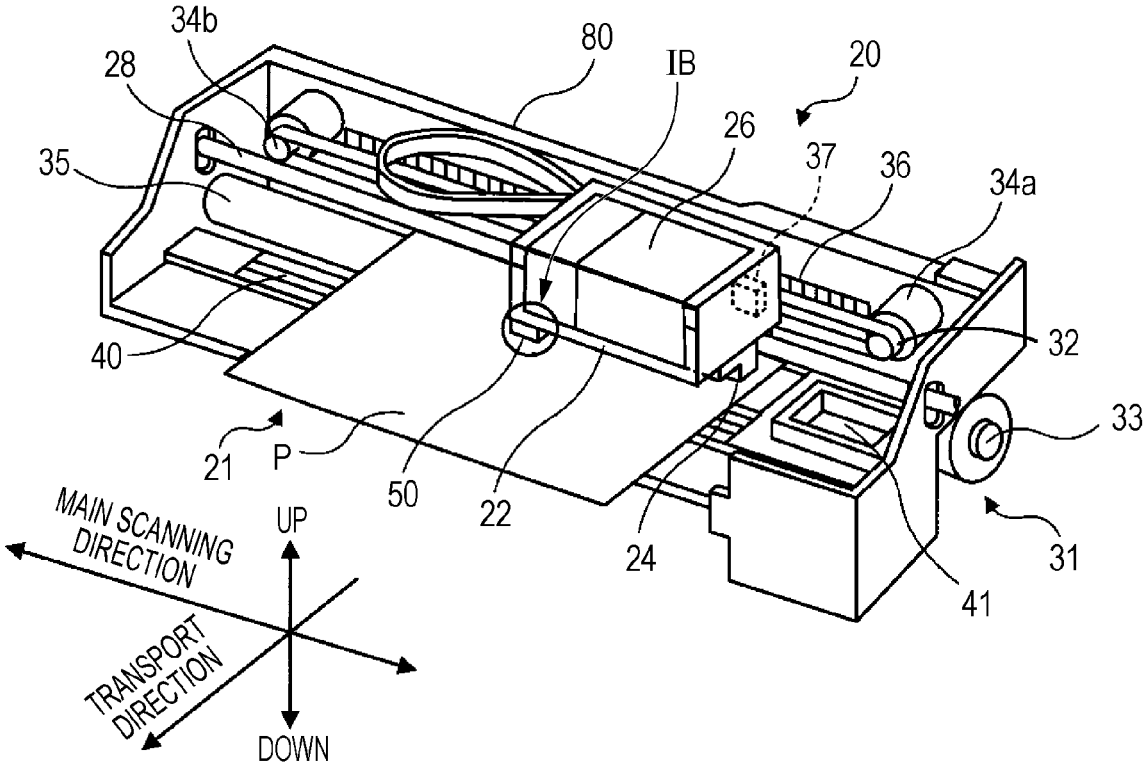
FIGS. 1A and 1B are configuration views illustrating the outline of the configuration of an ink jet printer according to an embodiment of the invention.
Figure 1B:
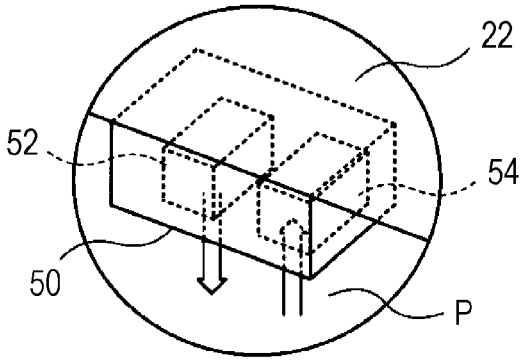
Figure 2:
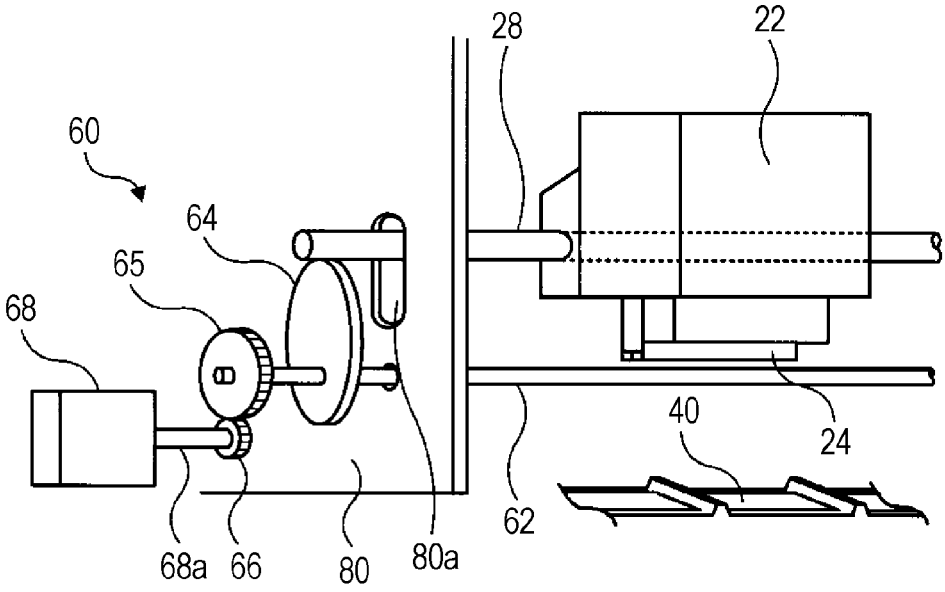
FIG. 2 is a configuration view illustrating the outline of a platen gap adjustment mechanism.
Figure 3:
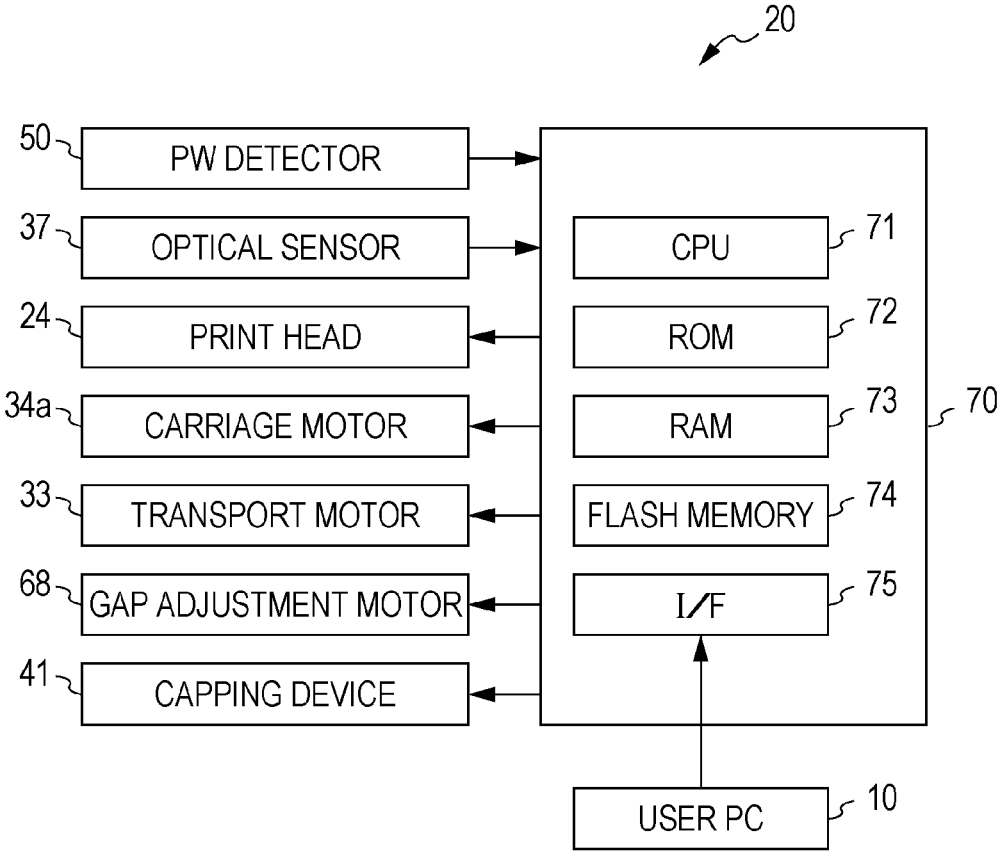
FIG. 3 is an explanatory view illustrating an electrical connection relationship focused on a controller.

Next, an embodiment of the invention will be described with reference to the following drawings. FIGS. 1A and 1B are configuration views illustrating the outline of an ink jet printer 20 which is an embodiment of the invention. FIG. 2 is a configuration view illustrating the outline of a platen gap adjustment mechanism 60. FIG. 3 is an explanatory view illustrating electrical connection focused on a controller 70.

As shown in FIGS. 1A and 1B, the ink jet printer 20 of the embodiment of the invention includes a paper feed mechanism 31 that transports a piece of recording paper P from the back to the front of the drawing by driving a paper feed roller 35 using a paper feed motor 33; a print mechanism 21 that performs printing in such a way that ink drops are discharged from a print head 24 onto the recording paper P transported on the platen 40 by the paper feed mechanism 31; a capping device 41 that seals the print head 24 formed on the right end of the platen 40 in the drawing; a platen gap adjustment mechanism 60 (refer to FIG. 2) that adjusts the interval (hereinafter, called a platen gap) between the nozzle surface of the print head 24 and the upper surface of the platen 40; and a controller 70 that controls the whole ink jet printer 20.

The print mechanism 21 includes a carriage motor 34*a* placed at the right side of a mechanical frame 80; a driven roller 34*b* placed at the left side of the mechanical frame 80; a carriage belt 32 installed between the carriage motor 34*a* and the driven motor 34*b*; a carriage 22 horizontally reciprocated along a guide 28 by the carriage belt 32 when the carriage motor 34*a* is driven; an ink cartridge 26 mounted on the carriage 22 and configured to separately contain each of the colors of ink, that is, yellow (Y), magenta (M), cyan (C) and black (K), which includes dyes or pigments functioning as colorants in water functioning as a solvent; a print head 24 configured to receive ink provided from the ink cartridge 26, and discharge ink drops; and a Paper Width (PW) detector 50 mounted on the print head 24 and configured to detect the left and right ends (paper width) of the recording paper P placed on the platen 40. An optical scale 36 is mounted on the mechanical frame 80 along the movement direction of the carriage 22, and an optical sensor 37 that includes a light emitting element (for example, a light emitting diode) and a light receiving element (for example, a phototransistor) is mounted on the rear surface of the carriage 22 such that the optical sensor 37 faces the optical scale 36. The position of the carriage 22 can be detected in such a way that the light receiving element receives light emitted from the light emitting element of the optical sensor 37 to the optical scale 36.

The PW detector 50 is configured as an optical sensor which includes a light emitting element 52 (for example, a light emitting diode) that emits light and a light receiving element 54 (for example, a phototransistor) as shown in FIGS. 1A and 1B, and the light receiving element 54 receives light emitted from the light emitting element 52 in the substantially vertical direction to the recording paper P or the platen 40 and reflected on the recording paper P or the platen 40, thereby converting the light into the electrical signal of a voltage the size of which is based on light intensity. Since the reflection of light at the platen 40 is different from that at the recording paper P, the right and left ends of the recording paper P can be detected in such a way that the PW detector 50 moves across the recording paper P with the reciprocation of the print head 24 in the main scanning direction.

Figure 4:
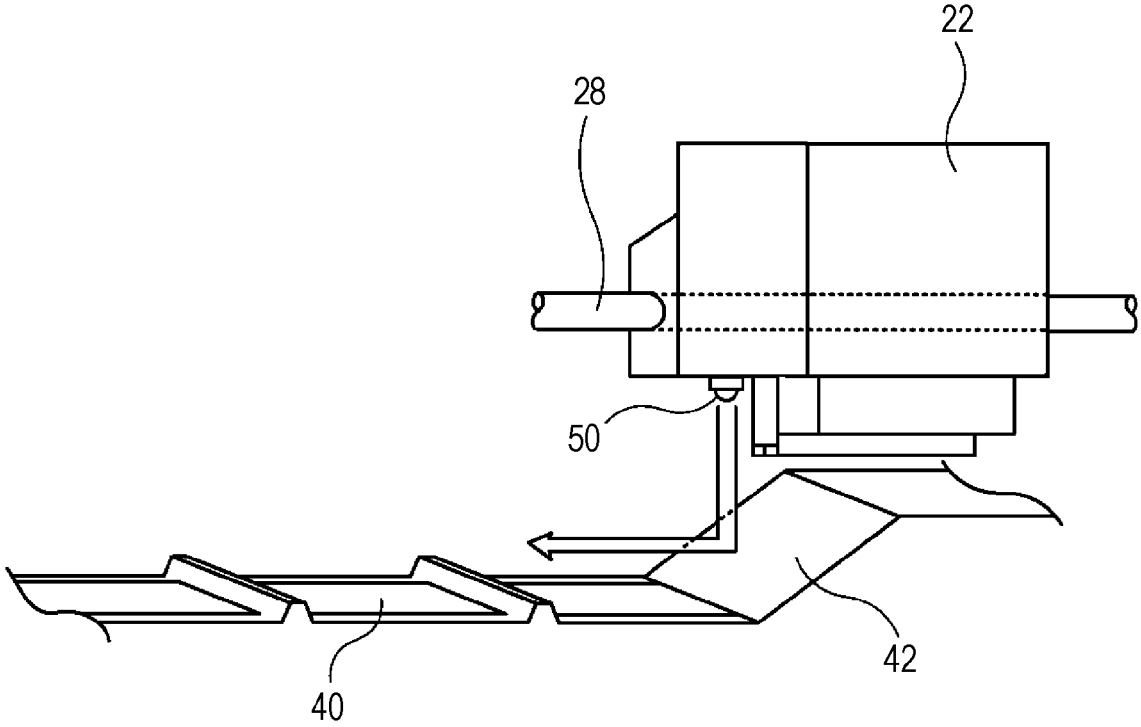
FIG. 4 is an explanatory view illustrating a state in which light from a PW detector is reflected on a reflection plate.

On the right end of the platen 40, a reflection plate 42 formed of, for example, a resin mirror is formed in such a way that the reflection plate 42 is inclined substantially at an angle of 45 degrees with respect to a paper placement surface of the platen 40. FIG. 4 illustrates a state in which light from a PW detector 50 is reflected on the reflection plate 42. As shown in the drawing, if light is emitted from the light emitting element 52 of the PW detector 50 when the carriage 22 is moved to the position in which the PW detector 50 faces the reflection plate 42, light is reflected on the reflection plate 42, and the reflected light proceeds in the substantially parallel direction to the paper placement surface of the platen 40. The reason why the reflection plate 42 is provided will be described later.

As shown in FIG. 2, the platen gap adjustment mechanism 60 includes a rotatable shaft 62 placed under the guide 28 of the carriage 22 in parallel to the guide 28; cams 64 fixed on both ends of the shaft 62 such that the surface of each of the cams comes in contact with the guide 28; a deceleration gear 65 fixed on one end of the shaft 62; and a gap adjustment motor 68 configured such that a gear 66 which is engaged with the deceleration gear 65 is fixed on a rotation axis 68*a*. In the mechanical frame 80, a longitudinal through-hole 80*a* is formed to allow the guide 28 to move only in the vertical direction. If the cam 64 rotates with the rotation of the shaft 62 attributable to the drive of the motor 68, the interval between the cam surface which comes in contact with the guide 28 and the rotation axis of the cam 64 varies according to the rotation angle thereof, with the result that the guide 28 moves in the vertical direction along the through-hole 80*a*, so that the interval between the print head 24 (a nozzle surface) and the platen 40, that is, the platen gap, is adjusted.

As shown in FIG. 3, a controller 70 is configured as a microprocessor centering on a Central Processing Unit (CPU) 71, and configured to include a Read Only Memory (ROM) 72 that stores various types of processing programs, a Random Access Memory (RAM) 73 that temporally stores data or maintains data, a flash memory 74 that is capable of writing/removing data, an interface (I/F) 75 that exchanges information with one or more external devices, and input/output ports (not shown). The RAM 73 includes a print buffer area such that print data transmitted from a user Personal Computer (PC) 10 via the interface (I/F) 75 is stored in the print buffer area. The controller 70 receives a signal from the optical sensor 37 and a signal from the PW detector 50 via the input port. Further, the controller 70 outputs a driving signal to be transmitted to the print head 24, a driving signal to be transmitted to the paper feed motor 33, the carriage motor 34*a* and the gap adjustment motor 68, and a signal or the like to be transmitted to the capping device 41 via the output port.

Figure 5:
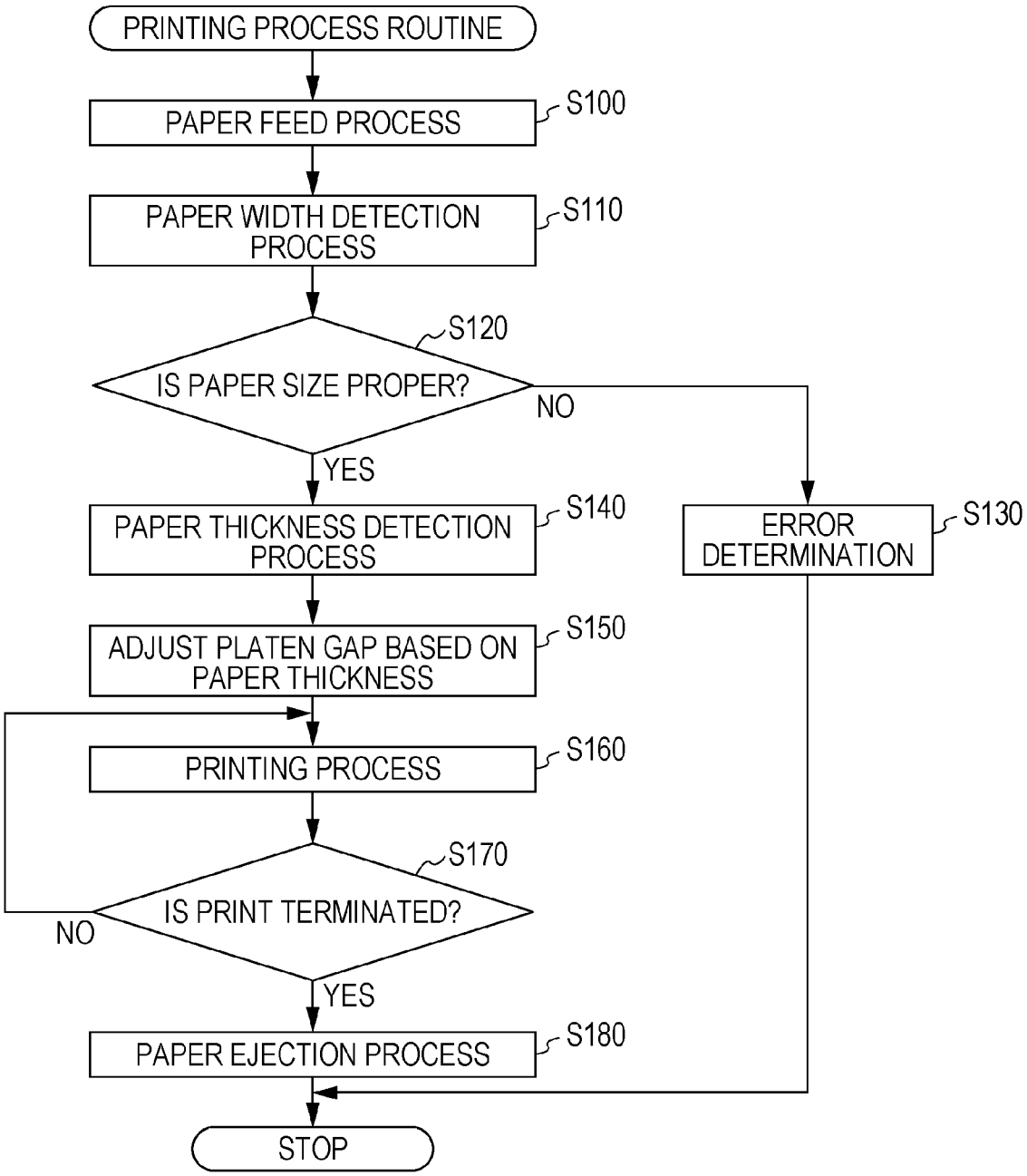
FIG. 5 is a flowchart illustrating an example of a printing processing routine.

Next, the operation of the ink jet printer 20 configured as described above according to the embodiment of the invention will be described. FIG. 5 is a flowchart illustrating an example of a printing processing routine executed by the controller 70. This routine is executed when a print job is received from the user PC 10. Meanwhile, the print job includes information about paper settings, such as the size of paper and the type of paper, in addition to a job Identification (ID) used to identify a job and image data.

If the printing processing routine is executed, the CPU 72 of the controller 70 controls the paper feed motor 33 first such that the recording paper P is fed on the platen 40 while driving the paper feed roller 35 (step S100). Thereafter, the controller 70 executes a paper width detection process in which the width of a piece of paper is detected in response to a signal detected by the PW detector 50 while moving the carriage 22 across the paper placed on the platen 40 by controlling the drive of the carriage motor 34*a* (step S110), determines whether the size of the paper based on the detected width of the paper is identical to the size of a paper included in the information about paper setting of the print job (step S120), determines an error when both sizes of paper are not identical to each other (step S130), and ends the routine without executing printing.

If it is determined that the sizes of paper are identical to each other, the controller 70 executes a paper thickness detection process thereafter (step S140), controls the driving of the gap adjustment motor 68 in order to adjust the platen gap such that the gap is enlarged as the thickness of the paper gets thicker based on the detected thickness of the paper (step S150), and executes the printing process based on the received print job (step S160) after the platen gap is adjusted. When printing is terminated (step S170), the controller 70 controls the paper feed motor 33 such that the recording paper P is discharged from the platen 40 while driving the paper feed roller 35 (step S180), and ends this routine.

Figure 6:
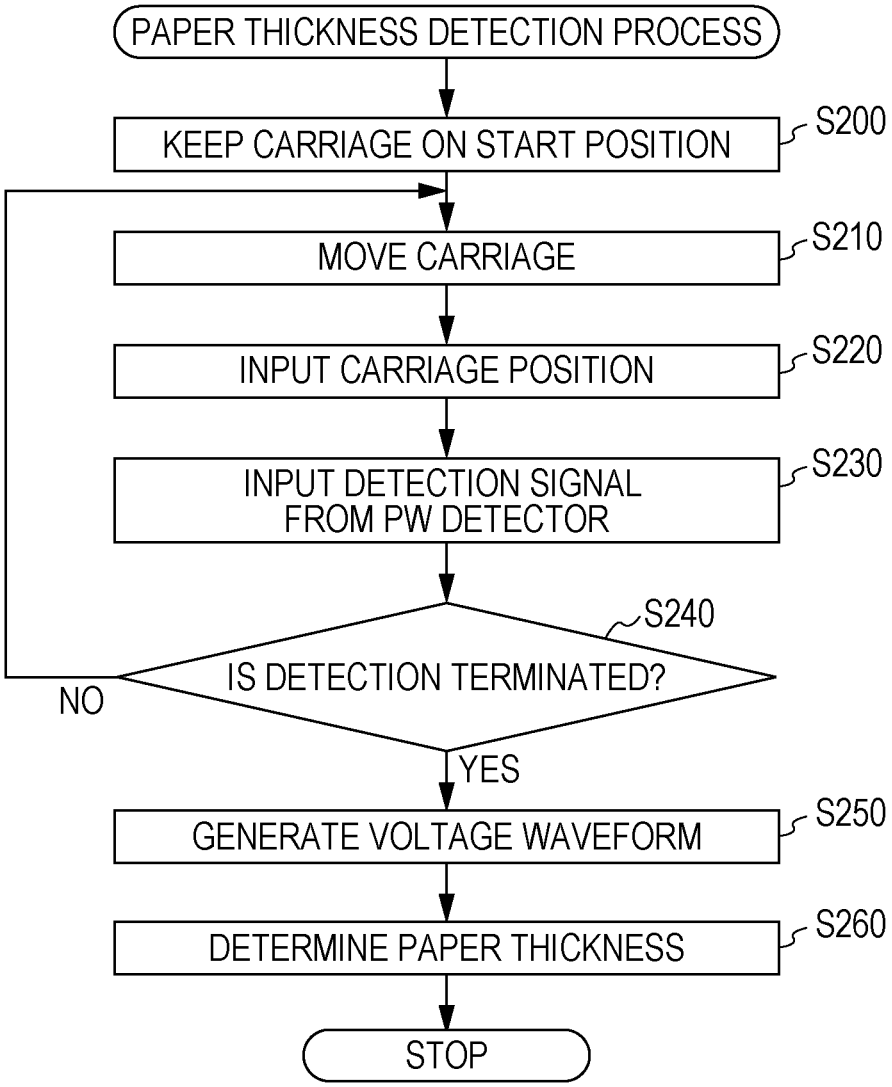
FIG. 6 is a flowchart illustrating an example of a paper thickness detection process.

FIG. 6 is a flowchart illustrating an example of the paper thickness detection process. In the paper thickness detection process, first, the carriage 22 is moved to a start position corresponding to the right end of the position which faces the reflection plate 42, and the carriage 22 is set to standby (step S200). Next, the carriage 22 is moved in the left direction by a unit movement interval (for example, an interval of 1 dot) (step S210), a carriage position from the optical sensor 37 is input (step S220), a voltage V from the PW detector 50 is input (step S230), and the detection ends. That is, the processes at steps S210 to S230, in which the carriage position from the optical sensor 37 and the voltage V from the PW detector 50 are input while the carriage 22 is moved by the unit movement interval in the left direction until the carriage 22 is moved to an end position which is the left end of the position in which the carriage 22 faces the reflection plate 42, are repeated. Thereafter, when the carriage 22 is moved to the end position and the detection is terminated, a voltage waveform is generated based on the input carriage position and the voltage V (step S250). The thickness of the paper is determined based on the width in which the carriage position corresponding to a voltage V, which exceeds a threshold Vref in the generated voltage waveform, is continuous (step S260), and this process ends.

Figure 7A:
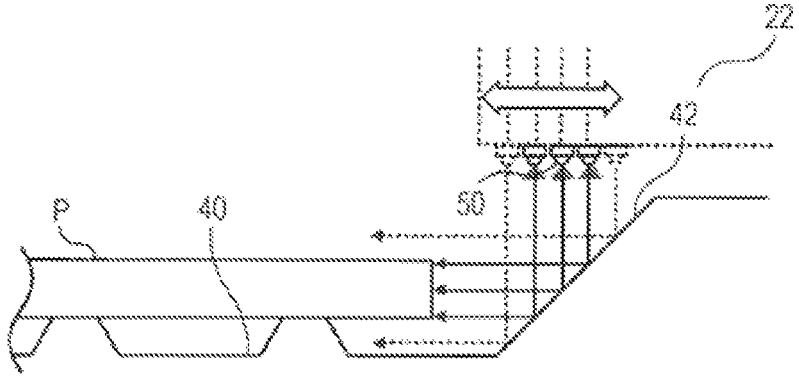
FIGS. 7A and 7B are explanatory views illustrating paper thickness detection.
Figure 7B:
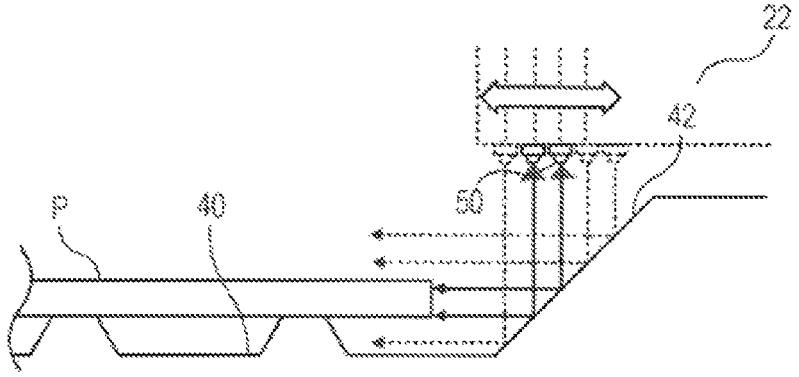
Figure 8A:
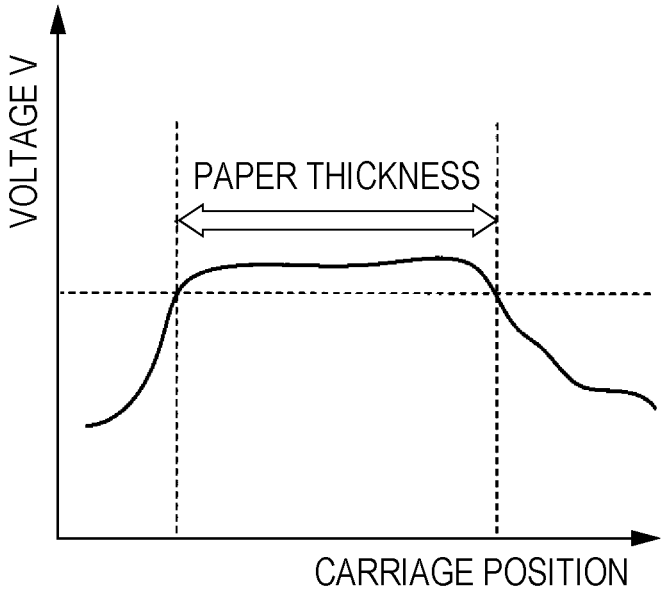
FIGS. 8A and 8B are explanatory views illustrating examples of signal waveforms obtained by the PW detector when paper thickness is detected.
Figure 8B:
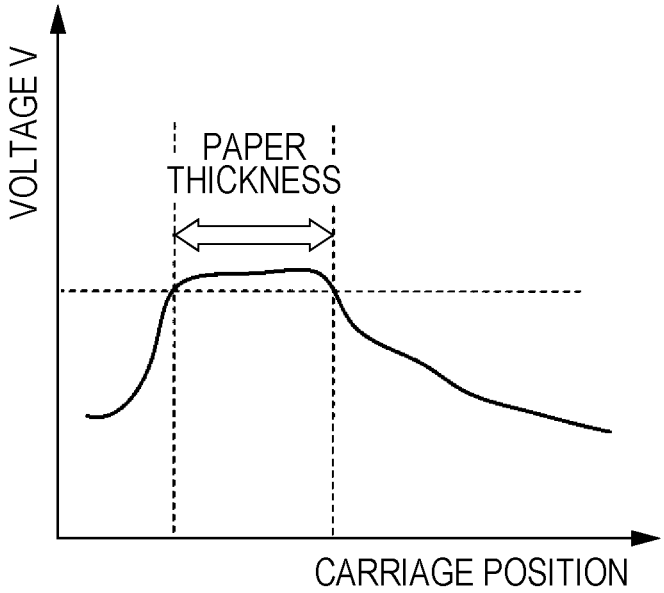

FIGS. 7A and 7B are explanatory views illustrating the state in which the PW detector 50 optically detects the side face of the recording paper P while moving the carriage 22. FIGS. 8A and 8B are explanatory views illustrating examples of the voltage waveforms detected by the PW detector 50. As shown in FIGS. 7A and 7B, light, emitted from the light emitting element 52 of the PW detector 50 in the substantially vertical direction to the surface of the platen 40, is reflected on the reflection plate 42 in the substantially parallel direction to the platen 40. When the side face of the recording paper P corresponds to the same direction as the direction of the reflected light, light is reflected on the side face of the recording paper P, and the reflected light is additionally reflected on the reflection plate 42 in the substantially vertical direction to the surface of the platen 40 and then received to the light receiving element 54 of the PW detector 50. On the other hand, when light emitted from the light emitting element 52 of the PW detector 50 is reflected on the reflection plate 42 and there is no side face of the recording paper P in the direction of the reflected light, light directly goes straight and reflected light is not detected by the light receiving element 54 of the PW detector 50. Therefore, the side face of the recording paper P can be optically detected by determining the threshold Vref such that a voltage level, obtained when light reflected on the side face of the recording paper P is received by the light receiving element 54, is distinguished from a voltage level obtained by the light receiving element 54 when light is not reflected on the side face of the recording paper P. As shown in FIGS. 8A and 8B, since the width, in which the carriage position corresponding to the voltage V which exceeds the threshold Vref in the generated voltage waveform is continuous, gets wider as the thickness of the paper gets larger, the thickness of the paper can be determined based on the width.

The relationship between the elements of the present embodiment and the elements of the invention will be clearly shown here. The print head 24 of the embodiment corresponds to "the discharge head" of the invention, the PW detector 50 corresponds to "a light emitting/receiving unit", the reflection plate 42 which is inclined to and formed on one end of the platen 40 corresponds to "a reflection member", the optical scale 36 and the optical sensor 37 correspond to "a position detection unit", and the controller 70, which performs the paper width detection process at step S110 of the printing process of FIG. 5 and the paper thickness detection process (the paper thickness detection process of FIG. 6) at step S140, corresponds to "a medium size determination unit". Further, the controller 70 and the platen gap adjustment mechanism 60 which perform the printing process of FIG. 5 correspond to "a control unit".

According to the ink jet printer 20 of the above-described embodiment, the PW detector 50 that detects the width of the recording paper P placed on the platen 40 is mounted on the carriage 22, the reflection plate 42 is formed on one end of the platen 40 and inclined to the surface of the platen at an angle of about 45 degrees, the carriage 22 is moved to a position which faces the reflection plate 42, a voltage waveform is generated by inputting the carriage position from the optical sensor 37 and the voltage V from the PW detector 50 (light receiving element 52) while moving the carriage 22 by a unit movement interval, and the thickness of the paper is determined based on the width, in which the carriage position corresponding to the voltage V which exceeds the threshold in the generated voltage waveform is continuous, with the result that a dedicated sensor that detects the thickness of a paper is not required to be prepared, so that an apparatus can be simplified.

In the above-described embodiment, even though the reflection plate 42 is formed of a resin mirror, the reflection plate can be formed of any member, such as a glass mirror, which can reflect light from the PW detector 50 in the substantially parallel direction to the surface of the platen 40, and which can reflect light from the substantially parallel direction to the surface of the platen 40 in the substantially vertical direction to the surface of the platen.

In the above-described embodiment, although the thickness of the paper is determined in such a way that a voltage waveform is generated based on the carriage position received from the optical sensor 37 and the voltage V received from the PW detector 50 while moving the carriage 22 by a unit movement interval, and that a width, in which the carriage position corresponding to the voltage V which exceeds the threshold Vref in the generated voltage waveform is continuous, is examined, the invention is not limited thereto, and, as shown in FIGS. 8A and 8B, the thickness of the paper may be estimated in such a way that a voltage waveform is experimentally obtained beforehand according to the type of paper, such as matt paper, standard paper or photo paper, the thicknesses of which are different from each other, and is stored in the ROM 72, and the type of paper is specified by matching the pattern of the generated voltage waveform and the stored voltage waveform. Further, the thickness of paper may be determined in such a way that the interval between both carriage positions is estimated by obtaining the carriage position from the optical sensor 37 when the voltage V from the PW detector 50 which is less than the threshold Vref becomes equal to or larger than the threshold Vref and the carriage position when the voltage V which is equal to or larger than the threshold Vref becomes less than the threshold Vref while moving the carriage 22.

In the above-described embodiment, although the ink jet printer 20 is used as an example of the image forming apparatus according to the invention, the invention is not limited thereto and may be applied to any apparatus, for example, Office Automation (OA) equipment, such as a facsimile or a copy machine, which can form an image on paper by discharging droplets.

Further, the invention is not limited to the above-described embodiment, and the invention can be implemented with various embodiments without departing from the technical scope of the invention.

What is claimed is:

1. An image forming apparatus that forms an image by discharging a liquid on a medium, the image forming apparatus comprising:

a discharge head that discharges a liquid;

a movement unit that reciprocates the discharge head such that the discharge head moves across the medium placed on a placement surface;

a light emitting/receiving unit that is mounted on the movement unit so as to be capable of moving, and that includes a light emitting section for emitting light in a substantially vertical direction to the placement surface and a light receiving section for receiving reflected light from the substantially vertical direction to the corresponding placement surface;

a reflection member that is formed on a non-placement surface which is different from the placement surface, and that, when the light emitting/receiving unit is moved into a position which faces the non-placement surface by the movement unit, reflects light emitted from the light emitting section in a substantially parallel direction to the placement surface, and that reflects the light from the substantially parallel direction to the placement surface in a substantially vertical direction to the corresponding placement surface;

a position detection unit that detects a position in a movement direction of the light emitting/receiving unit; and a medium size determination unit that performs operations of:

(a) determining a width of the medium based on a light reception signal detected by the light emitting/receiving unit and a position signal detected by the position detection unit while moving the light emitting/receiving unit such that the light emitting/receiving unit moves across the medium placed on the placement surface; and (b) determining a thickness of the medium based on the light reception signal detected by the light emitting/receiving unit and the position signal detected by the position detection unit while moving the light emitting/receiving unit such that the light emitting/receiving unit moves across the reflection member.

2. The image forming apparatus according to claim 1, wherein the medium size determination unit generates a light reception signal waveform in response to the light reception signal corresponding to each position of the light emitting/receiving unit, and determines the thickness of the medium based on the generated light reception signal waveform.

3. The image forming apparatus according to claim 2, wherein the medium size determination unit determines the thickness of the medium based on a width in which the position of the light emitting/receiving unit corresponding to the light reception signal from the light emitting/receiving unit, which exceeds a predetermined level in the generated light reception signal waveform, is continuous.

4. The image forming apparatus according to claim 2, wherein the medium size determination unit determines the thickness of the medium in such a way that a medium type is specified by comparing the generated light reception signal waveform with signal waveforms of a plurality types of medium each of which has a different thickness.

5. The image forming apparatus according to claim 1, further comprising:

a head interval adjustment unit that adjusts an interval between heads, which is an interval between the discharge head and the placement surface; and a control unit that controls the head interval adjustment unit such that the interval between heads is adjusted based on the thickness of the medium determined by the medium size determination unit when an image is formed on the medium, and that controls the movement unit and the discharge head such that the image is formed on the medium after the interval between the heads is adjusted.

6. The image forming apparatus according to claim 1, wherein the reflection member is a member on which a mirror processing is performed.

* * * * *